US011006234B2

(12) United States Patent
Matthias et al.

(10) Patent No.: US 11,006,234 B2
(45) Date of Patent: May 11, 2021

(54) AUDIO REPRODUCTION SYSTEM, METHOD FOR CONFIGURING AN AUDIO REPRODUCTION SYSTEM AND SERVER FOR AN AUDIO REPRODUCTION SYSTEM

(71) Applicant: Sennheiser electronic GmbH & Co. KG, Wedemark (DE)

(72) Inventors: Steffen Matthias, Hamburg (DE); Rafael Cauduro Dias de Paiva, Hamburg (DE); Konstantin Septinus, Hamburg (DE); Senthil Kumar Vellaichamy, Wedel (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 16/677,846

(22) Filed: Nov. 8, 2019

(65) Prior Publication Data

US 2020/0154226 A1 May 14, 2020

(30) Foreign Application Priority Data

Nov. 12, 2018 (DE) ..... 102018128202.8

(51) Int. Cl.

| | |
|---|---|
| ***H04S 7/00*** | (2006.01) |
| ***H04R 1/40*** | (2006.01) |
| ***H04R 3/00*** | (2006.01) |
| ***H04R 29/00*** | (2006.01) |
| ***H04S 3/00*** | (2006.01) |
| ***H04R 3/12*** | (2006.01) |

(52) U.S. Cl.

CPC ..... *H04S 7/301* (2013.01); *H04R 1/406* (2013.01); *H04R 3/005* (2013.01); *H04R 29/001* (2013.01); *H04S 3/008* (2013.01); *H04R 2420/07* (2013.01); *H04S 2400/01* (2013.01); *H04S 2400/13* (2013.01); *H04S 2400/15* (2013.01)

(58) Field of Classification Search

None

See application file for complete search history.

(56) References Cited

U.S. PATENT DOCUMENTS

| | | | | |
|---|---|---|---|---|
| 9,232,307 | B2 | 1/2016 | Sherman et al. | |
| 9,484,030 | B1 * | 11/2016 | Meaney | G10L 15/22 |
| 10,078,135 | B1 * | 9/2018 | Almada | G01S 5/30 |
| 10,425,780 | B1 * | 9/2019 | Devaraj | H04W 8/186 |

(Continued)

*Primary Examiner* — Qin Zhu

(74) *Attorney, Agent, or Firm* — Haug Partners LLP

(57) ABSTRACT

An improved method for configuring an audio reproduction device for detecting sound and providing different output audio signals in a plurality of rooms where at least two wireless microphones connect via a local network to an audio streaming server. Each of the wireless microphones detects room information indicating the room in which it is located, and transmits it to the server, together with an input audio signal. The server compiles at least two different output audio signals according to the respective room information from the input audio signals, and assigns each to a room. The output audio signals are provided via the local network in the rooms such that each of the output audio signals may be received in all rooms, and may be replayed only in the room to which it has been assigned. Each wireless microphone may be used in each of the rooms.

14 Claims, 2 Drawing Sheets

(56) References Cited

U.S. PATENT DOCUMENTS

| | | | | |
|---|---|---|---|---|
| 2015/0215699 | A1* | 7/2015 | Carlsson | H04R 3/02 381/71.8 |
| 2017/0236512 | A1* | 8/2017 | Williams | G06F 40/40 381/79 |
| 2017/0374482 | A1* | 12/2017 | McPherson | H04R 27/00 |
| 2018/0302716 | A1* | 10/2018 | Takasu | H04S 7/303 |
| 2019/0166423 | A1* | 5/2019 | Anderson | G06F 3/16 |
| 2020/0058311 | A1* | 2/2020 | Goodwin | G10L 19/008 |
| 2020/0128317 | A1* | 4/2020 | Feldman | H04R 19/04 |

* cited by examiner

AUDIO REPRODUCTION SYSTEM, METHOD FOR CONFIGURING AN AUDIO REPRODUCTION SYSTEM AND SERVER FOR AN AUDIO REPRODUCTION SYSTEM

The present application claims priority from German Patent Application No. 10 2018 128 202.8 filed on Nov. 12, 2018, the disclosure of which is incorporated herein by reference in its entirety.

FIELD OF THE INVENTION

The invention relates to an audio reproduction system, a method for configuring an audio reproduction system and a server for an audio reproduction system.

BACKGROUND

Audio reproduction systems for sound detection by means of a microphone and for providing output audio signals via loudspeakers have been known for long and are used in lectures, presentations, conferences etc.

U.S. Pat. No. 9,232,307 B2 discloses a wireless transmission system in which users may use their mobile device, e.g. a smartphone or PDA (Personalized Digital Assistant), at a convention or conference as a personal microphone for speaking via an existing amplifier system. They may also use the mobile device for listening via headphones to the signal reproduced via the amplifier system. For this purpose, the mobile device is connected to the amplifier system via a mobile network or a wireless local network. However, the user must first call a phone number to use the service, whether in the conference room or anywhere else. A moderator or a corresponding automated function assigns a caller a place on a speaker waiting list. However, one central microphone intended for the speaker is wired and is connected to the amplifier system independently from the mobile devices. It is therefore firmly tied to the room. Different rooms use separate transmission systems and each room needs a separate central microphone.

SUMMARY OF THE INVENTION

An object of the present invention is to provide an improved method for configuring an audio reproduction system for detecting sound and for providing different output audio signals in a plurality of rooms.

A method in accordance with the invention is disclosed. In the method, at least two wireless microphones connect via a wireless local network like e.g. WiFi/WLAN to a server. Each wireless microphone detects a room identifier, or room information respectively, that indicates in which room of a building the respective wireless microphone is located, and transmits the respective room information via the local network to the server. Further, each of the wireless microphones generates an input audio signal and transmits it via the local network to the server. In the server, at least two different output audio signals are composed or compiled from the input audio signals, according to the respective room information, and each output audio signal is associated with one of the rooms. The output audio signals are sent via the local network to the rooms such that each of the output audio signals may be received in several or all rooms. In one embodiment, the output audio signals are transmitted via the local network or a further, second local network to the rooms, where they may be received and reproduced by at least one sound reproducing device located in the respective room. The local network is preferably a wireless network ("WLAN"). The second local network can be a wired network for audio transmission, as used e.g. by DANTE.

The invention further relates to a server for an audio reproduction system for detecting sound and for providing different output audio signals in a plurality of rooms.

The invention further relates to a data carrier having stored thereon program code suitable for configuring a server to compile the at least two output audio signals from the input audio signals.

Further advantageous embodiments are described in the dependent claims.

The invention enables a more flexible use of an audio reproduction system, particularly with respect to the utilized microphones. Further, the configuration of such flexible audio reproduction system is simplified.

BRIEF DESCRIPTION OF THE DRAWINGS

Further details and advantageous embodiments are depicted in the drawings, showing in FIG. 1 an overview over a local network connected to a plurality of rooms.

DETAILED DESCRIPTION OF THE INVENTION

Figure 1:
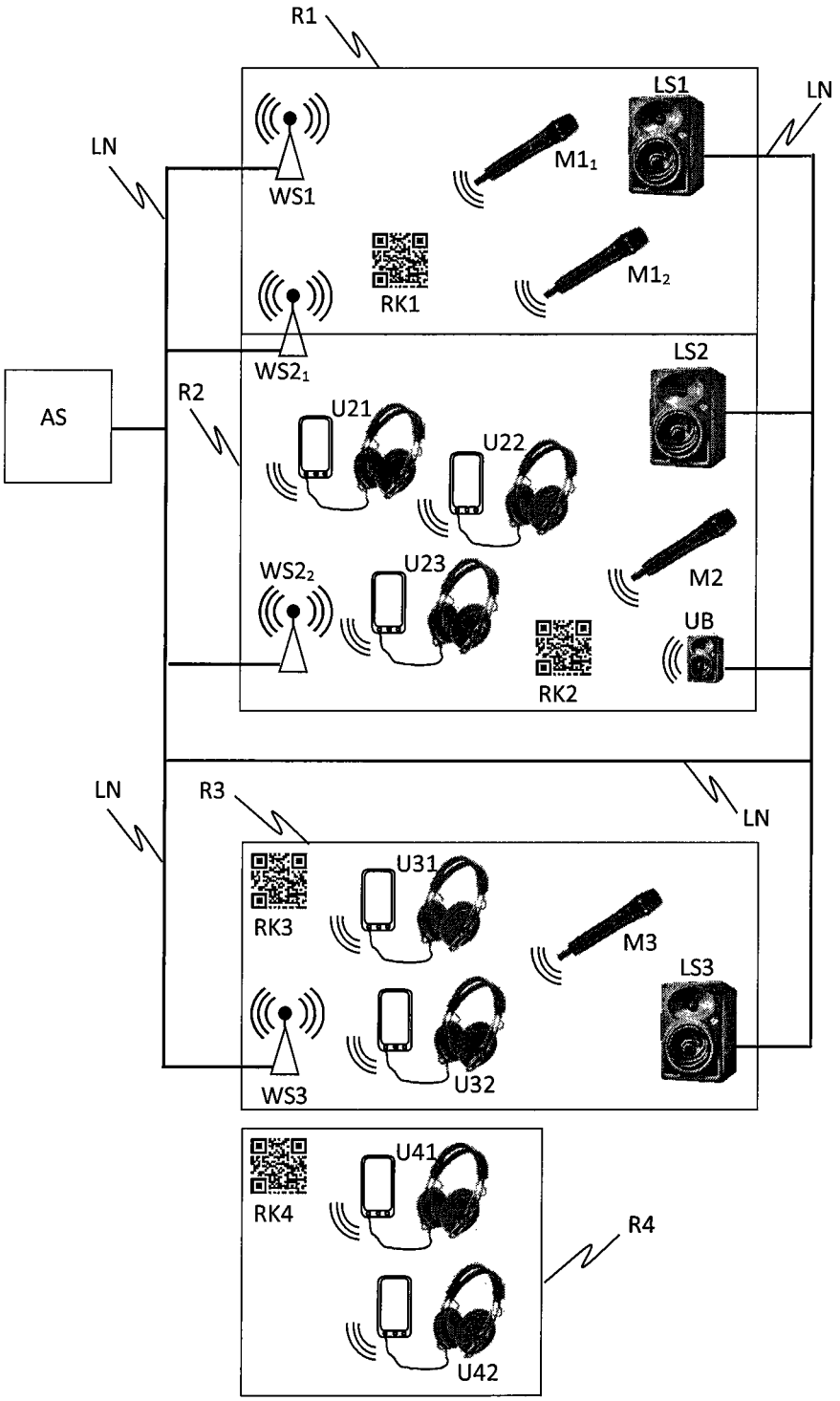

FIG. 1 shows an overview over a local network LN, e.g. Wi-Fi (IEEE-802.11) or LTE, that is connected to a plurality of rooms R1, R2, R3, R4. The local network LN may also be a (logically complete) portion of a mobile radio network, such as LTE or "5G", or at least use the same technology as a mobile radio network. The rooms may but need not necessarily be located in the same building. Each room is located in the reception area of at least one wireless base station WS1, WS$\mathbf{2}_1$, WS$\mathbf{2}_2$, WS3 of the local network LN. One or more of the wireless base stations may also be located in the rooms, wherein their signal can then usually be received also outside the respective room. At least one audio streaming server AS is connected to the local network LN. The audio streaming server AS, which is hereafter referred to as server only, implements the center of an audio reproduction system for sound detection that is usable in the rooms R1, . . . , R4, and provides different output audio signals for the rooms. For sound detection, one or more wireless microphones M$\mathbf{1}_1$, M$\mathbf{1}_2$, M2, M3 may be in the rooms. The wireless microphones are connected to the server AS via the local network LN, e.g. via one of the wireless base stations WS1-WS3. Likewise, an audio reproduction is possible in each of the rooms R1, . . . , R4. The audio reproduction may be done by fixed or mobile loudspeakers LS1, LS2, LS3, or by mobile devices U21-U42, such as e.g. correspondingly configured smartphones of users. In each of the rooms R1, . . . , R4, at least one specific audio signal that is assigned to the respective room by the server AS may be reproduced, e.g. one that was recorded by one or more wireless microphones M$\mathbf{1}_1$-M3 in the same room.

However, none of the wireless microphones M$\mathbf{1}_1$-M3 is permanently assigned to one of the rooms R1, . . . , R4. Instead, each of the wireless microphones M$\mathbf{1}_1$-M3 may be used in each of the rooms. However, it is automatically assigned temporarily only to the room in which it is physically located. This is done by the wireless microphone detecting room information RK1, RK2, RK3, RK4 that is detectable only in the respective room. The room information RK1, . . . , RK4 may be e.g. an acoustic, an optic or an electromagnetic signal. Suitable for this purpose is e.g. an ultrasonic signal that is emitted in the room and that comprises a room indication or room identifier. In another variant, a QR code, bar code or something similar comprising a room identifier is provided in the room in order to be detected by the wireless microphone. In a further variant, an electromagnetic near field (NFC) is used that is available only in the room and that comprises a room identifier. When the wireless microphone leaves the room, the temporary assignment may be resolved.

A wireless microphone $M1_1$-M3 that is brought into the room is connected to the local network LN, but initially not assigned to any room. In the room, the wireless microphone preferably automatically detects the room information RK1, . . . , RK4 and transmits it via the local network LN to the server AS. The assignment of the room information to a room R1, . . . , R4 is known to the server AS, so that by means of this assignment it may automatically detect in which of the rooms the wireless microphone $M1_1$-M3 is currently located. To this room it assigns it temporarily.

For example, a first wireless microphone $M1_1$ may be brought into a first room R1, as shown in FIG. 1, while a second wireless microphone M2 is brought into a second room R2. After each of the two wireless microphones M1, M2 detected the respective room identifier RK1, RK2 and transmitted it via the local network LN to the server AS, the latter temporarily assigns each of the wireless microphones to its respective room R1, R2.

Each of the wireless microphones generates an input audio signal and transmits it via the local network LN to the server AS. The server generates, corresponding to the room identifier RK1, . . . , RK4, from the input audio signals at least two output audio signals that differ from each other and that are also assigned to one of the rooms R1, . . . , R4 each. The server AS provides these output audio signals via the local network LN, which can be received in all rooms, at least to the respective room to which it is assigned. However, the room in which the respective wireless microphone is located and to which the respective input audio signals are therefore assigned, needs not coincide with the room to which the output audio signal is assigned. As already mentioned above, the local network is usually not necessarily limited to a room, so that the output audio signals may also be physically received in other rooms near the respective room. In one embodiment, the output audio signals may be received in the entire area of the local network LN. In one embodiment, the server AS may additionally ensure that each output audio signal can only be reproduced in the room or rooms to which it has been assigned.

For example, the server may assign an output audio signal generated from an input audio signal $M1_1$ of a first wireless microphone that is located in the first room R1 to this first room R1. At the same time, the server may assign a second output audio signal generated from an input audio signal of a second wireless microphone M2 located in the second room R2 to this second room R2. Since usually different events take place in the different rooms R1, R2 in which the wireless microphones $M1_1$, M2 are used, the input audio signals as well as the output audio signals differ from each other, depending on the room. However, the assignment of the wireless microphones $M1_1$, M2 to the rooms R1, R2 is flexible and only temporarily valid.

Due to this flexibility it is possible, for example, that a further wireless microphone $M1_2$ which is connected to the local network and which is also brought into the first room R1 and has detected the room identifier RK1 of this room, is also assigned to this room. The signals of both wireless microphones $M1_1$, $M1_2$ assigned to this room R1 may be mixed in the server AS, and the mixed audio signal may be assigned as output audio signal to the room R1. Likewise it is possible, for example, that an audio signal coming from a wireless microphone M3 located in a third room R3 is assigned to this third room R3 and to further rooms, e.g. a fourth room R4. The fourth room R4 is located within the reception area of the local network LN, e.g. due to a nearby wireless base station WS3, as shown in FIG. 1. However, it needs not necessarily be directly adjacent to the third room R3. If the fourth room R4 has an own room identifier RK4 that differs from the room identifier RK3 of the third room, the assignment of input and output audio signals to the two rooms may be done independent from each other. In principle, the room identifier of the fourth room R4 may also be the same as that of the third room R3, so that the server does not differ between the two rooms.

The server may not assign an input audio signal neither an output audio signal to a room that has no room identifier. Therefore, in one embodiment, a mobile device there may connect to the local network LN, but not reproduce an output audio signal. In another embodiment however, the server may unlock an output audio signal, thus allowing it to be played back in the entire reception area of the local network LN, or in a defined part thereof. But this is an additional mode that is required only in exceptional cases, e.g. at a central event where the audience may be in several rooms that are distributed all over a building. If a wireless microphone is located in a room that is within the reception area of the local network LN but has no room identifier, it will either not output an audio signal, or the server will ignore its input audio signal or at least will not be able to assign it to an output audio signal.

The transmission of the output audio signal via the local network LN may be done in different ways. In one embodiment, the server AS provides via a 1:1 connection (unicast), individually for each authenticated sound reproducing device, a downlink stream comprising the output audio signal assigned to the respective room. In another embodiment, the server generates a list of sound reproducing devices that are authenticated for a particular room or a particular output audio signal, and provides the respective output audio signals via a 1:N connection (multicast) to the sound reproducing devices contained in the list. In a further embodiment, the server AS transmits to each authenticated sound reproducing device only key information that is required for audio reproduction by the sound reproducing device, while the output audio signals may be received freely.

Advantageously, in principle each wireless network with a low latency can be used as local network LN, such as for example WLAN/WiFi, LTE or similar. For the complete system comprising wireless transmission from the microphone, processing at the server and transmission to the sound reproducing devices, a low latency below a maximum value of few milliseconds, e.g. 20 ms, should be maintained.

In one embodiment, there will be initially only control data including the room information RK1, . . . , RK4 transmitted via the connection from the wireless microphone $M1_1$-M3 via the local network LN to the server AS. Audio output from the wireless microphone is initially disabled and will only be enabled after the server verified the control data and unlocked the wireless microphone.

In one embodiment, detecting the room information RK1, . . . , RK4 is done acoustically in at least one of the wireless microphones. In this case, the room information may be emitted e.g. as ultrasound from the loudspeaker (LS1, LS2, LS3). Alternatively, the room information may be emitted as ultrasound from another suitable additional loudspeaker (e.g. ultrasonic beacon UB), e.g. if the loudspeaker LS2 is not suitable for ultrasound. In a variant, the server may adaptively adjust the volume for the reproduction of the room information to the volume of the (low-frequency, e.g. below 15 kHz) sound recorded by the wireless microphone, so as to make use of the psychoacoustic masking effect. The louder the recorded (low-frequency) sound, the louder will the room information (higher frequency, e.g. above 18 kHz) be acoustically played back. Alternatively, the room information is acoustically played back only if the recorded (low-frequency) sound has a minimum volume. This prevents persons in the room that may sense the room information from being disturbed. Otherwise, acoustic transmission e.g. in the very high audible or near-ultrasonic frequency range of 18-20 kHz might disturb in particular persons who may sense this signal, e.g. children.

In another embodiment, detecting the room information RK1, . . . , RK4 is done in at least one of the wireless microphones optically, e.g. using an optical display that is electronically controlled by the server. In a further embodiment, detecting the room information RK1, . . . , RK4 in at least one of the wireless microphones is done by an electromagnetic near field (NFC).

In one embodiment, the server may, after a certain time or periodically, require a re-authentication of the wireless microphone and/or the sound reproducing device in order to ensure that it is still within the respective room. In this case, it is advantageous if the wireless microphone or sound reproducing device respectively can detect the room information at any time. This is possible e.g. with ultrasonic transmission or with optically transmitted room information that uses an electronically controlled optical display (e.g. infrared beacon, display for QR code etc.). In one embodiment, the server AS may control the room information RK1, RK2, RK3 centrally, and modify it in certain time intervals. However, in this case it may happen that all sound reproducing devices in the room detect the modification simultaneously and signal it back to the server, which may lead to undesired traffic peaks in the local network LN or at the server AS respectively, e.g. in a larger lecture hall. Therefore, in a variant, the server may modify the room information of different rooms in a time-shifted manner.

A sound reproducing device, such as e.g. a loudspeaker or a mobile receiver (e.g. smartphone) with headphones or earphones that is in one of the rooms may receive and replay at least the output audio signal assigned to the respective room in which it is. However, it is also possible that it may receive via the local network several or all other output audio signals provided by the server. In one embodiment, the sound reproducing device may automatically select the output audio signal that is assigned to the respective room in which it is currently located. For this purpose, also the sound reproducing device may detect the room information RK1, . . . , RK4 in its environment. But, in one embodiment, it may reproduce only the output audio signal that is assigned to the room in which it is currently located. In this case, the sound reproducing device may authenticate itself to the server, i.e. prove to the server that it is in the room, by means of the room information. In response, the server will unlock for it the output audio signal assigned to the respective room.

In principle, the sound reproducing device may also detect another, alternatively usable unique room information that is in the room, instead of using the same room information as the wireless microphone. The different types of room information need not necessarily be identical, as long as the server uniquely assigns both to the same room. For example, in FIG. 1, a wireless microphone M2 and a first mobile receiver U21 that are in a room R2 may detect the room information RK2 by an electromagnetic near field, while a second mobile receiver U22 that is also in the same room R2 detects the room information acoustically by an ultrasonic signal. The server assigns the room information transmitted by the electromagnetic near field and the room information transmitted by the ultrasonic signal uniquely to the same room R2. If the server assigns the input audio signal generated by the wireless microphone M2 as output audio signal to the room R2, it may be received via the local network LN through one of the wireless base stations $WS2_1$, $WS2_2$ and replayed by both (or all) mobile receivers U21, U22 in the room R2.

Further, a loudspeaker LS2 in the same room R2 may be mobile or fixedly installed and also receive the output audio signal via the local network LN. The loudspeaker may replay the output audio signal that is assigned to the room in which the loudspeaker currently is. Likewise, the ultrasonic beacon UB may be mobile or fixedly installed and also receive the room information via the local network LN. In one embodiment, also the loudspeaker LS2 detects the respective room information RK2 and uses it to authenticate itself to the server AS. In another embodiment however, if the loudspeaker is fixedly installed, it may be addressable by the server via a fixed (network) address and is thereby authenticated indirectly.

Figure 2:
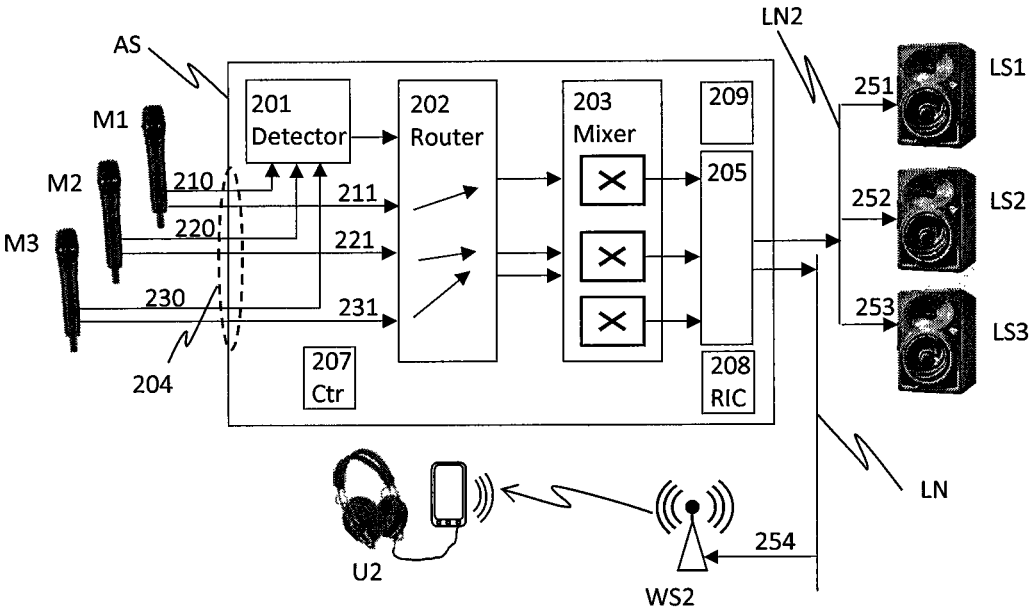
FIG. 2 a block diagram of a server, according to an embodiment.

FIG. 2 shows a block diagram of a server AS, according to the invention, for an audio reproduction system for sound acquisition and for providing various output audio signals. The server may receive via a local network LN several different input audio signals 211, 221, 231 from different wireless microphones M1, M2, M3 and provide different output audio signals 251, 252, 253, 254 in several rooms. For this purpose, the server AS comprises an (input) interface 204, through which it may be connected to a local network LN and through which it may connect to at least two wireless microphones M1, M2, M3. This may be done e.g. via an uplink streaming service provided by the server. Initially, the server receives from each of the wireless microphones a signal 210, 220, 230 with control data and in particular with room information RK1, RK2, RK3 indicating, from the plurality of rooms reached by the local network, the room in which the respective wireless microphone is. This signal 210, 220, 230 is fed to a detector 201 that may verify the control data and that assigns each of the wireless microphones to a room by means of the room information. In one embodiment, the audio output of each microphone, or its processing in the server respectively, is initially switched off, and will be switched on only after the detector 201 has verified the control data and enabled the respective wireless microphone, or the processing of its audio output signals respectively. The audio output signals of the wireless microphones are substantially the input audio signals 211, 221, 231 of the server AS.

The assignment information from the detector 201 is fed to a router 202, which can be programmable in order to flexibly assign the input audio signals 211, 221, 231 to the output audio signals 251, . . . , 254. In particular, it is also possible to assign a plurality of input audio signals to a single output audio signal, as indicated in FIG. 2. In the depicted example, input audio signals 221, 231 from two wireless microphones M2, M3 are assigned to the same output audio signal. Herein, at least two output audio signals 251, . . . , 254 are composed from the input audio signals 211, 221, 231, according to the room information RK1, RK2, RK3 associated with the input audio signals. Finally, all input audio signals that are associated with one and the same output audio signal 251, . . . , 254 are mixed in a mixer 203.

The router 202 and the mixer 203, and optionally also the detector 201, may form an associating unit that comprises at least one processor. This is configurable by means of software so as to compose the at least two output audio signals from the input audio signals.

Moreover, the server AS comprises an output unit 205 for providing the at least two output audio signals 251, . . . , 254 via the local network LN and/or a further local network LN2. As described above, this is done in such a way that the output audio signals 251, . . . , 254 are receivable in the plurality of rooms R1, R2, R3. Furthermore, in each room at least the output audio signal that is associated with it may be automatically selectable by means of the room information.

For the reproduction, the server AS may establish a connection to at least one sound reproducing device U2, LS1-LS3 via the local network LN or the further local network LN2, in order to transmit to the sound reproducing device the output audio signal 251, . . . , 254 that is associated with the respective room in which the sound reproducing device is located. As explained above, the sound reproducing device may be e.g. a loudspeaker LS1-LS3 or a wireless mobile device U2 that is connected via a base station WS2 and that has an audio playback function. In one embodiment, the server AS additionally comprises a control unit 207, wherein the server first receives from each of the wireless microphones $M1_1$-M3 only control data including the room information RK1, . . . , RK4, and the control unit verifies the control data. Only then the control unit enables the reception of the input audio signal 211, 221, 231 from the wireless microphone via the local network.

Further, the server AS may comprise a room information control unit 208, which may, via the local network LN, control and modify the room information emitted in one or more of the rooms R1, . . . , R4. The room information control unit 208 may be connected to the control unit 207.

In one embodiment, the server comprises a receiver assignment unit 209 by which it may receive, from a mobile sound reproducing device, room information of the room in which the mobile sound reproducing device is located, in order to then send to it, individually via a wireless connection, the output audio signal 254 that is associated with this room. Communication for this assignment may be done via the local network LN and a wireless base station WS2.

It is to be noted that FIG. 2 shows an input interface 204 and an output interface 205, which may be one physical unit, however. In other words, the input interface 204 and the output interface 205 may be implemented as a single bidirectional network interface towards the local network LN. Further, it is to be noted in FIG. 2 that the output unit 205 is a logical unit comprising two parts, one of which is connected to the local network LN and the other to the further local network LN2.

Figure 3:
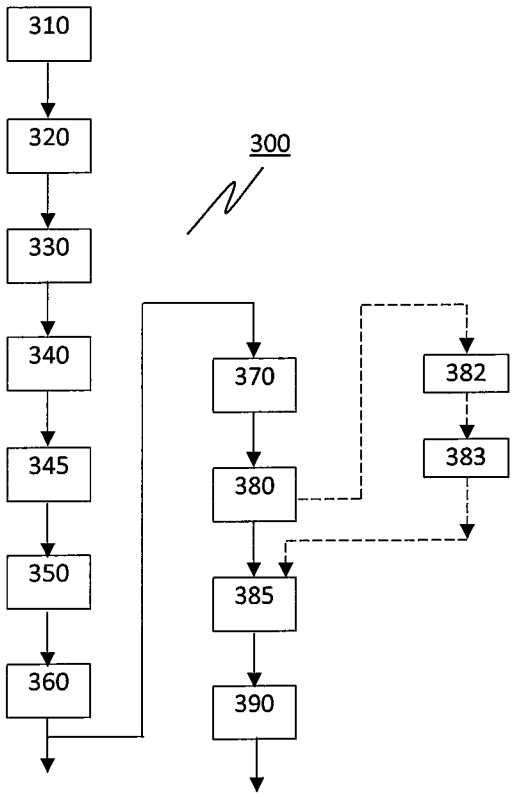
FIG. 3 a flow-chart of a method according to the invention.

FIG. 3 shows a flow-chart of a method for configuring an audio reproduction system for sound detection and for providing different output audio signals to a plurality of rooms R1, . . . , R3. The method 300 comprises the steps of connecting 310 at least two wireless microphones M1, M2, M3 to a server AS via a local network LN, each wireless microphone detecting 320 a room information RK1, RK2, RK3, wherein the room information indicates, from a plurality of rooms, the room in which the respective microphone is currently located, then transmitting 330 the respective room information via the local network from each wireless microphone to the server, generating 340 an input audio signal in each wireless microphone and transmitting 345 the respective input audio signal via the local network to the server. Further, the input audio signals are compiled 350 or combined respectively in the server to obtain at least two output audio signals 251, . . . , 254, wherein the compiling is done in accordance with the room information. The at least two output audio signals are each assigned to one of the rooms and differ from each other. Finally, the at least two output audio signals 251, . . . , 254 are provided 360 via the local network LN such that each of the output audio signals can be received in the plurality of rooms.

In one embodiment, the method further comprises transmitting 370 the output audio signals 251, . . . , 254 via the local network LN and/or the further local network LN2 into the plurality of rooms. In one embodiment, at least one sound reproducing device LS1-LS3, U21-U42 that is in one of the plurality of rooms may receive 380 and replay 390 the output audio signal associated with the room in which the respective sound reproducing device is.

In one embodiment, the output audio signals 251, . . . , 254 are transmitted into at least one of the plurality of rooms R1, R2, R3 via the local network LN as well as via the further local network LN2, wherein the further local network LN2 is a DANTE network. At least one of the sound reproducing devices connected to it is fixedly installed and comprises one or more loudspeakers LS1, LS2, LS3.

In one embodiment, the local network is wireless, and the receiving 380 and replaying 390 of an output audio signal 251, . . . , 254 assigned to the room is done by a plurality of sound reproducing devices LS1-LS3, U21-U42 that are in the respective room. At least two of the sound reproducing devices are mobile devices U21-U42 that each do the replaying 390 via headphones or earphones. In this embodiment, the method further comprises the steps of detecting 382 the room information RK1, . . . , RK4 or another, alternatively usable room information that is available in the same room, by each of the at least two mobile devices, and selecting 383 the output audio signal assigned to the respective room in each of the mobile devices. Using the detected room information, the selecting may be done automatically. In one embodiment, only authenticated sound reproducing devices or mobile devices respectively may reproduce the output audio signal associated with the respective room, while playback is prevented for non-authenticated sound reproducing devices. A sound reproducing device or mobile device is authenticated if the output audio signal to be reproduced by it is associated with the room whose room information it has detected.

In one embodiment, the invention relates to a data carrier having stored thereon program code adapted for configuring a server as described above, so that it compiles the at least two output audio signals from the input audio signals. In another embodiment, the invention relates to a data carrier having stored thereon program code adapted for configuring a mobile device to detect room information in its environment, authenticate itself via a local network to a server by using the room information and then can replay an output audio signal received from the server via the local network.

The invention is advantageously usable with audio reproduction systems for sound acquisition and sound output, in particular for providing different output audio signals in a plurality of rooms.

The various embodiments mentioned above may be combined with each other, even if such combination is not expressly mentioned.

The invention claimed is:

1. A method for configuring an audio reproduction system for sound detection and for providing different output audio signals in a plurality of rooms, comprising:

connecting at least two wireless microphones via a local network with a server;

in each wireless microphone, detecting room information, wherein the room information indicates the room among the plurality of rooms in which the wireless microphone is located;

transmitting control data initially, wherein the control data includes the respective room information, via the local network from each wireless microphone to the server;

generating in each wireless microphone an input audio signal and transmitting the respective input audio signals via the local network to the server;

in the server, compiling the input audio signals to obtain at least two output audio signals, wherein the compiling is performed according to the room information, and wherein the at least two output audio signals are each assigned to one of the rooms and differ from each other; and providing the at least two output audio signals via the local network and/or a further local network so that each output audio signal is receivable in the plurality of rooms;

wherein an audio output of each of the at least two wireless microphones, or a processing of an audio output of each of the at least two wireless microphones within the server, is initially disabled, and is enabled for each of the at least two wireless microphones after the server verifies the control data and unlocks the respective wireless microphone.

2. The method according to claim 1, wherein the room information is controlled by the server and is detectable only in the respective room.

3. The method according to claim 1, wherein the detecting the room information in at least one of the at least two wireless microphones is performed acoustically, and the room information is emitted as ultrasound by a loudspeaker.

4. The method according to claim 3, wherein the server adaptively adjusts a volume for reproduction of the room information to a volume of sound acquired by the wireless microphone.

5. The method according to claim 1, wherein the detecting the room information in at least one of the at least two wireless microphones is performed optically.

6. The method according to claim 1, wherein the detecting the room information in at least one of the at least two wireless microphones is performed by an electromagnetic nearfield.

7. The method according to claim 1, further comprising:

transmitting at least one of the at least two output audio signals via the local network and/or the further local network into the plurality of rooms; and receiving and replaying at at least one sound reproducing device (the output audio signal associated with the room in which the respective sound reproducing device is located.

8. The method according to claim 7, wherein the at least one of the at least two output audio signals are transmitted into at least one of the rooms via both the local network and the further local network, and wherein the further local network is a DANTE network and at least one of the sound reproducing devices connected to the further local network comprises one or more loudspeakers.

9. The method according to claim 7, wherein the local network is wireless, and wherein the receiving and replaying of the output audio signal associated with the room is performed by a plurality of mobile sound reproducing devices that are in the room and that each are connected to headphones or earphones, the method further comprising:

in each of the mobile sound reproducing devices, detecting the room information or another, alternatively usable room information available in the same room, and in each of the mobile sound reproducing devices, selecting the output audio signal assigned to the room, wherein said selecting the output audio signal assigned to the room is done automatically in each of the mobile sound reproducing devices by means of the detected room information.

10. A server for an audio reproduction system for sound detection and for providing different output audio signals in a plurality of rooms, comprising:

an interface for connecting to a local network and configured for connecting to at least two wireless microphones via the local network;

receiving a signal with room information from each of the at least two wireless microphones, wherein the room information indicates the room, of the plurality of rooms, in which the respective wireless microphone is located; and receiving an input audio signal from each of the at least two wireless microphones via the local network;

a control unit;

an associating unit for compiling at least two output audio signals from the input audio signals, wherein the compiling is performed according to the room information of the input audio signals, and wherein the at least two output audio signals are each assigned to one of the rooms and differ from each other, and wherein the associating unit comprises at least one processor that is configurable by means of a software program so as to compile the at least two output audio signals from the input audio signals; and an output unit for providing the at least two output audio signals via the local network and/or a further local network so that each of the output audio signals is receivable in the plurality of rooms;

wherein the server initially receives from each of the at least two wireless microphones control data including the room information, and wherein the control unit verifies the initially received room information and, upon the room information being verified, enables reception of the input audio signal from the respective wireless microphone via the local network or enables a processing of the input audio signal received from the respective wireless microphone.

11. The server according to claim 10, further comprising:

a room information control unit configured to modify the room information in the plurality of rooms via the local network.

12. The server according to claim 10, wherein the server is configured to establish an individual wireless connection via the local network to at least one mobile sound reproduction device and use the individual wireless connection to transmit to the mobile sound reproducing device the output audio signal that is associated with the respective room in which the sound reproducing device is located, wherein the server further comprises a receiver assignment unit that is adapted to receive from the mobile sound reproducing device room information of the room in which the sound reproducing device is located.

13. A non-transitory data carrier having stored thereon program code suitable for configuring a server according to claim 10 to compile the at least two output audio signals from the input audio signals.

14. A method for configuring an audio reproduction system for sound detection and for providing different output audio signals in a plurality of rooms, comprising:

connecting at least two wireless microphones via a local network with a server, wherein the local network is wireless;

in each wireless microphone, detecting room information, wherein the room information indicates the room among the plurality of rooms in which the wireless microphone is located;

transmitting the respective room information via the local network from each wireless microphone to the server;

generating in each wireless microphone an input audio signal and transmitting the respective input audio signals via the local network to the server;

in the server, compiling the input audio signals to obtain at least two output audio signals, wherein the compiling is performed according to the room information, and wherein the at least two output audio signals are each assigned to one of the rooms and differ from each other, and providing the at least two output audio signals via the local network and/or a further local network so that each output audio signal is receivable in the plurality of rooms, wherein at least one of the at least two output audio signals is transmitted via the local network and/or the further local network into the plurality of rooms; and receiving and replaying at at least one sound reproducing device the output audio signal associated with the room in which the respective sound reproducing device is located, wherein the receiving and replaying of the output audio signal associated with the room is performed by a plurality of mobile sound reproducing devices that are in the room and that each are connected to headphones or earphones;

in each of the mobile sound reproducing devices, detecting the room information or another, alternatively usable room information available in the same room; and in each of the mobile sound reproducing devices, selecting the output audio signal assigned to the room, wherein said selecting the output audio signal assigned to the room is done automatically in each of the mobile sound reproducing devices by means of the detected room information.

* * * * *